US008431071B2

(12) United States Patent
Imam et al.

(10) Patent No.: US 8,431,071 B2
(45) Date of Patent: Apr. 30, 2013

(54) SINTERING OF METAL AND ALLOY POWDERS BY MICROWAVE/MILLIMETER-WAVE HEATING

(75) Inventors: M Ashraf Imam, Great Falls, VA (US); Arne W Fliflet, Alexandria, VA (US)

(73) Assignee: The United States of America, as represented by the Secretary of the Navy, Washigton, DC (US)

( * ) Notice: Subject to any disclaimer, the term of this patent is extended or adjusted under 35 U.S.C. 154(b) by 61 days.

(21) Appl. No.: 12/870,037

(22) Filed: Aug. 27, 2010

(65) Prior Publication Data

US 2012/0051962 A1 Mar. 1, 2012

(51) Int. Cl.
*B22F 3/12* (2006.01)

(52) U.S. Cl.
USPC ..... 419/57; 419/60

(58) Field of Classification Search ..... 419/2, 52, 419/57, 60; 264/402, 413, 414; 219/678, 219/759
See application file for complete search history.

(56) References Cited

U.S. PATENT DOCUMENTS 5,736,092 A * 4/1998 Apte et al. ..... 264/432
6,183,689 B1 2/2001 Roy et al.
2005/0032025 A1 2/2005 Bhaduri et al.
2008/0114468 A1 5/2008 Kumar
2009/0079101 A1 3/2009 Laubersheimer et al.
2011/0020168 A1* 1/2011 Tang et al. ..... 420/417

OTHER PUBLICATIONS

Bruce et al., "Joining of Ceramic Tubes Using a High-Power 83-GHz Millimeter-Wave Beam" IEEE Trans. Plasma Sci., 33(2), 668-678 (2005).
Bruce et al., "Microwave Sintering and Melting of Titanium Powder for Low-Cost Processing" Key Engineering Materials, 436, 131-140 (2010).
Froes et al., "Cost Affordable Developments in Titanium Technology and Applications" Key Engineering Materials, 436, 1-11 (2010).
Imam et al., "Recent Advances in Microwave, Millimeter-Wave and Plasma-Assisted Processing of Materials" Presentation at THERMEC' 2009, Berlin (Aug. 27, 2009).
Kutty et al., "Gradient surface porosity in titanium dental implants: relation between processing parameters and microstructure" J. Mat. Sci.: Mat. Med., 15, 145-150 (2004).
Lewis III et al., "Recent Advances in Microwave and Millimeter-Wave Processing of Materials" Mat. Sci. Forum, 539-543, 3249-3254 (2007).
Roy et al., "Full sintering of powdered-metal bodies in a microwave field" Nature, 399, 668-670 (1999).
Tetsuro, "Microwave Sintering of Metal Matrix Alloys" Reports of Research Institute of Industrial Products Technology, 6, 129-134 (2005) (only abstract available and submitted).
PCT Search Report and Written Opinion in PCT/UC11/48347 (Jan. 5, 2012).

* cited by examiner

*Primary Examiner* — Roy King
*Assistant Examiner* — Ngoclan T Mai
(74) *Attorney, Agent, or Firm* — Amy L. Ressing; Joseph T. Grunkemeyer

(57) ABSTRACT

A method of sintering by: placing a compacted metal powder inside a cylindrically-shaped susceptor and in an inert atmosphere or a vacuum, and applying microwave or millimeter-wave energy to the powder until the powder is sintered.

15 Claims, 4 Drawing Sheets

SINTERING OF METAL AND ALLOY POWDERS BY MICROWAVE/MILLIMETER-WAVE HEATING

TECHNICAL FIELD

The present disclosure is generally related to sintering of metals.

DESCRIPTION OF RELATED ART

The perception of titanium has quickly changed from a specialty metal to being a common engineering metal. As titanium becomes more of a household word, methods to lower the costs of titanium components must be developed (Imam M. A. and Froes F. H., "Low Cost Titanium and Developing Applications", JOM (Journal of Metals), TMS publication, May 2010, pp. 1720, Reed et al., "Induction Skull Melting Offers Ti Investment Casting Benefits" *Industrial Heating*, Jan. 10, 2001. All patent documents and publications referenced throughout this application are incorporated herein by reference.). These words were written almost a decade ago and their import is even greater today as new technologies are emerging that provide even lower cost titanium powders. For decades, titanium usage was only where critical to meet very high performance, reliability, structural integrity and other factors because of the high cost of the extraction and the manufacturing processes, the latter being typically a vacuum arc re-melting (VAR) process. However, high density inclusions (HDI) and hard alpha inclusions (HAI) were still sometimes present, introducing the risk of failure of the component-a risk that is to be avoided due to the nature of use of many titanium components such as in aircraft. Since both types of defects are difficult to detect, it is desirable to use an improved or different manufacturing process. In more recent years, the addition of cold hearth or "skull" melting as an initial refining step in an alloy refining process has been successful in eliminating the occurrence of HDI inclusions without the additional raw material inspection steps necessary in a VAR process. The cold hearth melting process has also shown promise in eliminating hard alpha inclusions.

Skull melting is a very pure melting process based on a water-cooled metallic crucible, which makes the melt solidify immediately when coming into contact with the cold crucible wall resulting in formation of a solid crust. This so-called skull protects the crucible against the hot melt and permits a melting process without any disturbing impurities. The energy, necessary to heat-up, melt down and overheat the charge, is transferred via an electron beam, plasma arc, or the electromagnetic field of an inductor. In electron beam cold hearth melting, a sophisticated and expensive "hard" vacuum of $10^{-6}$ Torr or better system is critical since electron beam guns will not operate reliably at higher pressures. This vacuum also far exceeds the vapor pressure point of aluminum, which is often an element in titanium alloys. As a result evaporation of elemental aluminum results in potential alloy inconsistency and furnace wall contamination. Electrode consumption and resulting impurities are problems for plasma arc heating. To provide sufficient electromagnetic transparency for induction heating, the metallic crucible is usually slotted, and consists therefore of several segments that are electrically isolated against each other complicating the design. Moreover, induction heating is less effective for heating the titanium powders that are being produced in the emerging more cost effective ore reduction technologies.

The processing of a mass of powder is usually consists of two steps: consolidation and sintering. The consolidation of powder is usually performed in a closed die, although other means such as roll compaction, isostatic compaction, extrusion or forging can be used. Regardless of the technique employed, each produces densification of the powder mass that can be related to the density of the solid metal at its upper limit.

Sintering is the bonding of particles in a dense mass of powder by incipient fusion in the solid state through the application of heat. Powders differ from solid metals in having a much greater ratio of surface area to volume. This excess surface energy provides the driving force for sintering. During sintering, the shapes of the particles change to reduce pore volume and decrease surface area. Sintering can be considered to proceed in three stages. During the first, neck growth between particles proceeds rapidly but powder particles remain discrete. During the second, most of the densification occurs as the particles diffuse toward each other via vacancy migration. During the third, grain size increases, isolated pores form, and densification continues at a much lower rate. The rate of sintering has a significant effect on compact properties and can be modified by either physical or chemical treatments of the powder or compact or by incorporating reactive gases in the sintering atmosphere.

The conventional method of sintering is to heat the compacted powder in a resistively heated or oil/gas-fired furnace that is energy intensive. Moreover, the time at temperature for sintering is necessarily long because of the thermal inertia of the furnace leading to large grain size that in turn reduces the strength of the material.

BRIEF SUMMARY

Disclose herein is a method comprising: placing a compacted metal powder inside a cylindrically-shaped susceptor and in an inert atmosphere or a vacuum; and applying microwave or millimeter-wave energy to the powder until the powder is sintered.

BRIEF DESCRIPTION OF THE DRAWINGS

A more complete appreciation of the invention will be readily obtained by reference to the following Description of the Example Embodiments and the accompanying drawings.

DETAILED DESCRIPTION OF EXAMPLE EMBODIMENTS

Figure 1:
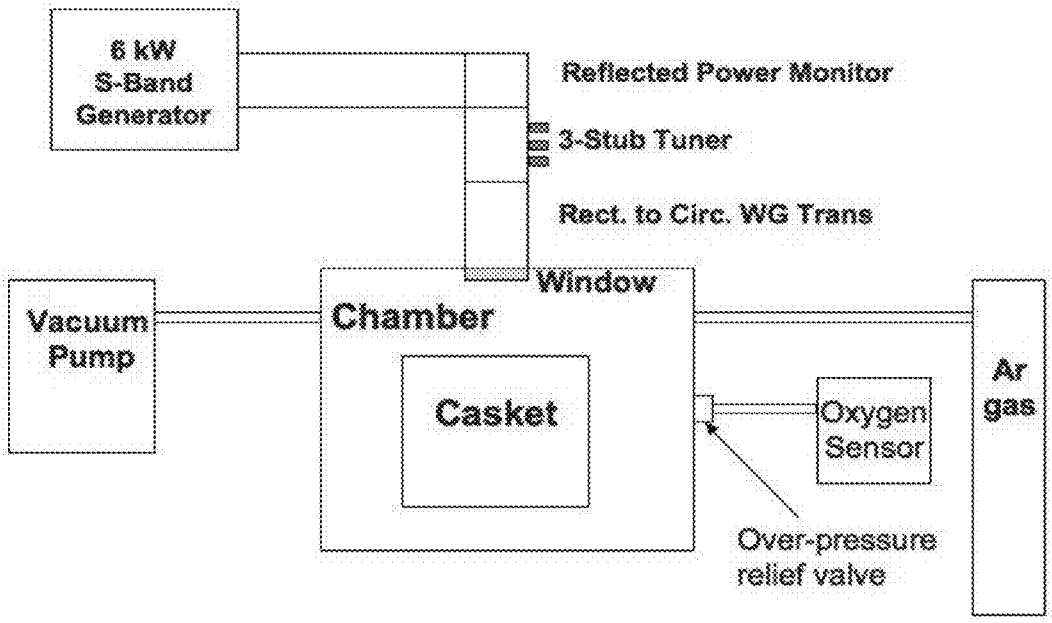
FIG. 1 schematically illustrates the component/subsystem layout of a 2.45 GHz microwave processing system.

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

A robust S-Band microwave system has been developed for sintering titanium powder compacts up to few hundred grams in mass. Microwave sintering in an argon gas or vacuum environment is a potentially energy efficient alternative approach to sintering titanium powders as it can avoid the problems associated with vacuum furnaces. The microwave generation process is efficient and power deposition is limited to the work piece and surrounding regions. This reduces the power needed and processing time for a considerable energy savings. The application of microwave and millimeter-wave processing to ceramic and metallic materials has been investigated (Fliflet et al., "Application of Microwave Heating to Ceramic Processing: Design and Initial Operation of a 2.45 GHz Single-Mode Furnace" *IEEE Trans. Plasma Sci.,* 24, 1041 (1996); Lewis et al., "Material Processing with a High Frequency Millimeter-wave Source" *Mater. Manuf. Process.* 18, 151-167 (2003); Lewis et al., "Recent Advances in Microwave and Millimeter-Wave Beam Processing of Materials" Materials Science Forum vols. 539-543, pp. 3249-3254, 2007). Discloses herein are results for titanium processing based on an S-Band microwave and millimeter-wave systems in which titanium powder compacts are sintered in a ceramic crucible (Imam et al., "Recent Advances in Microwave, Millimeter-Wave and Plasma-Assisted Processing of Materials" Materials Science Forum, vols. 638-642, pp. 2052-2057 (2010)).

The direct heating of dense, fully processed metals by microwave/millimeter-waves is not effective due to the high conductivity of the metal surface and the low penetration depth of the energy. This is not the case with powder metal compacts with significant inter-particle volume. These should be treated, at least from an electrical standpoint, as artificial dielectrics—a composite of the metal powder and gas/vacuum. In a powder compact the metal particles are separated by dielectric regions comprised of air, inert gas, or vacuum, and, frequently, a thin oxide coating. These features significantly modify the interaction from the pure metal case (Roy et al., "Full Sintering of powdered-metal bodies in a Microwave Field" *Nature* vol. 399, pp. 668-670, 1999; Bykov et al., "Microwave Heating of Conductive powder Materials" *J. Appl. Phys.* vol. 99, 023506 (2006)). The predominant interaction is eddy currents induced on or near the particle surface. These currents can produce strong coupling to the microwave/millimeter-wave fields resulting in efficient, localized heat generation. This eddy-current interaction can persist until near full densification especially at elevated temperatures.

A difficulty in heating titanium to sintering temperatures is that it is highly reactive with oxygen at elevated temperatures. Therefore exposure of the powder to oxygen may be minimized during the processing cycle. Therefore the titanium powder may be heated to temperatures over 1100° C. in an oxygen-free atmosphere to achieve sintering.

The metal powder can be a powder of one or more of any metals or alloys, including, but not limited to, titanium and titanium alloys. The powder is provided in the form of a compacted powder, also known as a green compact. The compact may be in any shape, including in the shape of a desired final product. The compact may have a density of at least 30% of the bulk density of the metal. This includes, but is not limited to, densities of 40-90%. Generally, a higher density compact can lead to a more dense sintered product. A lower density compact may produce a porous structure. A porous structure may be closed-pored, but may be made open-pored with the use of a gas former in the compact.

The compact is placed inside a cylindrically-shaped susceptor, which assists in converting the microwave or millimeter-wave energy to heat while the powder is at a lower temperature. As the powder warms, conversion to heat within the compact is more efficient. As used-herein, "cylindrically-shaped" refers to any shape that approximately coaxially surrounds an incident microwave or millimeter-wave beam where it contacts the powder. A circular cylinder having open ends with the compact placed inside is one example.

A suitable frequency range for the microwave or millimeter-wave energy is from 0.9 to 90 GHz, including, but not limited to 2.45 GHz and 83 GHz. The peak temperature of the compact may be from 1000° C. or about half the melting temperature of the powder up slightly below the melting point of the powder. The energy application may last from, for example, 10 minutes to one hour or more to complete the sintering.

Since the disclosed method makes use of microwave/millimeter-wave non-ionizing radiation to heat the compacted powder, it can greatly reduce the energy input needed because only the insulated workpiece is heated. With appropriate casketing to maintain an isothermal bath, the compacted powder can be heated rapidly to an optimum sintering temperature, held for an optimum period, and then cooled rapidly, resulting in shorter overall processing times for further energy savings as well as improved microstructure properties including increased strength due to less grain growth. Microwave heating uses clean electrical power and the wall plug efficiency is high, up to 70%. The temperature control of the workpiece during microwave/millimeter-wave processing can be obtained by means of appropriate temperature diagnostics and control systems. Microwave processing can be efficient with a range of batch sizes allowing better matching of production to demand. This process may reduce the cost by using less energy compared to conventional processes and at same time maintain high strength by not increasing grain size.

The following examples are given to illustrate specific applications. These specific examples are not intended to limit the scope of the disclosure in this application.

Example 1

83 GHz sintering—Powders of titanium and its alloys were selected for microwave/millimeter-wave sintering because titanium and its alloys exhibit a unique combination of properties, which include good modulus of elasticity, a high strength-to-density ratio, and excellent corrosion resistance and as such they are selected for many applications. To minimize exposure to oxygen, titanium powder in a sealed container was placed in a glovebox with a purified inert gas (helium or argon) atmosphere. Powders of titanium and its alloys were uniaxially pressed in the range of 15-30 ksi (5-15 tons of load) in the glovebox into pellets of 1 cm height×1.27 cm diameter. The initial compressed density was in the range of 75-95% of theoretical. The compacts were placed in sealed bags and moved to a vacuum sintering chamber. Millimeter-wave sintering was carried out at the Naval Research Laboratory (NRL) Gyrotron Beam Materials Processing Facility. The system is comprised of a 15 kW CW Gycom, Ltd. gyrotron, a cryogen-free superconducting magnet, power supplies, cooling system, control system, a work chamber of approx. 1.7 $m^3$ volume with optics for controlling the beam, and a variety of feedthroughs and ports for various types of material processing setups and diagnostics. The gyrotron operates near 83 GHz, and the output is produced in the form of a free-space quasi-Gaussian beam, which is transported and focused using mirrors onto various processing configurations in a controlled atmosphere or vacuum. The facility is fully computer controlled via LabView™ and includes extensive in-situ instrumentation and visual process monitoring. Further details of the apparatus can be found in published reports (Bruce et al., "Joining of Ceramic Tubes Using a High-Power 83-GHz Millimeter-Wave Beam" *IEEE Trans. Plasma Sci.* 33(2), 668-678 (2005); Lewis et al., "Material Processing with a High Frequency Millimeter-wave Source," *Mater. Manuf. Process.* 18, 151-167 (2003)).

The sintering was done at different temperatures ranging from 1000-1550° C. for durations of 10 minutes to an hour in a 50 mTorr vacuum. Relatively low beam powers (a few hundred watts to kilowatts) were needed for the heating indicating good energy conversion efficiency. The best result was obtained for sample that was compacted at 15 tons uniaxial load and sintered at 1550° C. for 1 hour. The resulting density was 99%. The process can be used to sinter compressed powder into near-net-shape parts.

Example 2

2.45 GHz sintering—Titanium sintering experiments were carried out in a specialized microwave processing chamber designed to optimize the microwave heating of the titanium powder compact and minimize the presence of oxygen. The chamber and related hardware were also designed to allow processing temperatures over 1800° C. and input microwave powers over 2 kW. The microwave processing set up is shown schematically in FIG. 1. The chamber is constructed mainly from stainless steel and incorporates a number of ports for microwave input, atmosphere control, and diagnostics. The chamber is cylindrical in shape with a diameter of 12 in. and a height of 10 in. and is capable of being pumped out to a pressure of 0.01 millitorr. Microwave power is provided by a 6 kW S-Band Cober S6F industrial microwave generator and is injected into the center of the top of the chamber through a 4 in. diameter, 0.25 in thick quartz window. The titanium powder compact is contained in a casket comprised of crucibles, setter powders, and alumina fiberboard. The casket is located directly under the microwave window to maximize the microwave fields in the casket. A 3-stub tuner is used to minimize the microwave power reflected from the chamber. Oxygen contamination was minimized during processing by using a flowing argon gas atmosphere maintained at a 0.5 psi overpressure. Oxygen presence was monitored using an Ametek oxygen sensor. Prior to beginning processing the chamber was pumped down to a pressure of about a millitorr using a mechanical pump followed by a sorption pump. The temperature of the upper surface of the titanium work piece was monitored using a two-color pyrometer.

Figure 2:
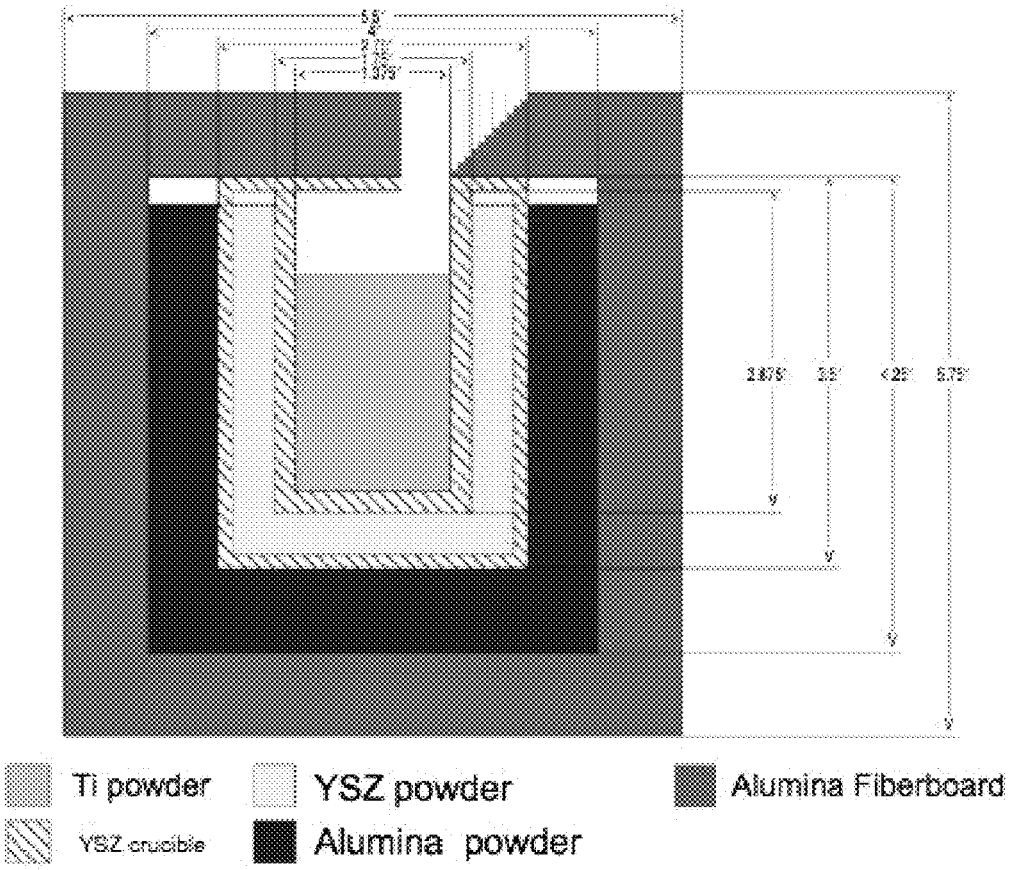
FIG. 2 shows a schematic cross section of the casketing system.

A special casket, shown schematically in FIG. 2, was developed to thermally insulate the sintered titanium, minimize heat loss, and provide hybrid heating during the initial heating phase. The titanium powder compact was contained in a zirconia crucible. The zirconia crucible was placed in an alumina crucible with yttria stabilized zirconia (YSZ) powder packed around it. The relatively lossy YSZ powder provides hybrid heating as well as thermal insulation. The alumina crucible was placed in a "box" made of low-loss alumina fiberboard that provides additional thermal insulation and spatial positioning. Apertures in the crucible lids and fiberboard cover provide line-of-sight access for the pyrometer.

To minimize exposure to oxygen prior to processing, titanium powder in a sealed container was placed in a glovebox with a purified inert gas (helium or argon) atmosphere. Powders of titanium and its alloys were uniaxially pressed in the range of 15-30 ksi (5-15 tons of load) in the glovebox into disks of 1 cm thick×2.87 cm diameter. The initial compressed density was typically in the range of 30-90% of theoretical though two experiments were conducted with densities below this to determine the effect of initial density upon sintering/melting behavior. Several disks were pressed together to form a single compact.

Figure 3:
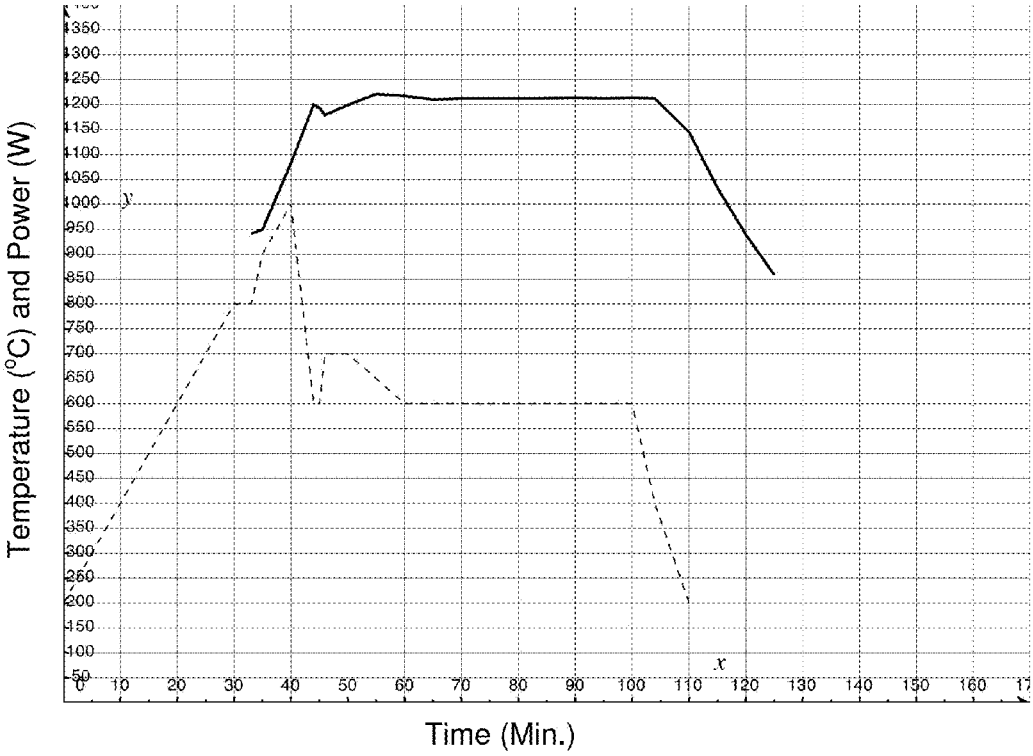
FIG. 3 shows power and temperature profiles for a titanium sintering experiment. Solid curve: power in Watts, dashed curve: temperature in ° C.
Figure 4:
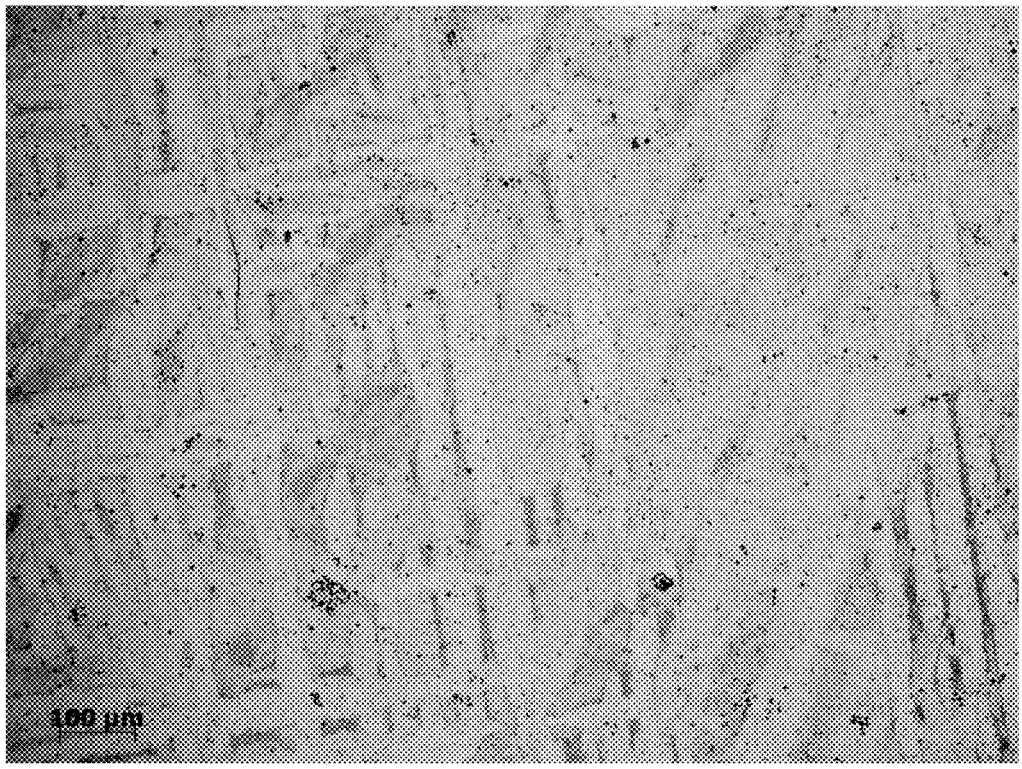
FIG. 4 shows a micrograph of a cut through a titanium compact sintered to 98% theoretical density.

Sintered Compacts with Variable Porosity—A series of Ti powder compacts having different green densities were sintered by the disclosed method. The results in Table I show that as the green density is lowered, the sintered part increases in porosity. The green density was controlled by varying the compaction pressure. The porosity of the sintered titanium compact can be varied by more than 30% by varying the compaction pressure used to form the green compact. At the highest compaction pressures the porosity is almost totally eliminated. The sintering hold time was varied from 15 to 60 minutes not including the ramp-up and cool-down times but hold time did not greatly affect the final density suggesting that the most of the densification occurs rapidly. Typical power and temperature profiles of a sintering process with a one-hour hold at maximum temperature are shown in FIG. 3. The microstructure of a Cold Isostatically Pressed (CIP'd) titanium rod sintered to approximately 98% theoretical density is shown in FIG. 4.

TABLE I

Porosity of sintered Ti compacts.

| Pressure (kpsi) | Green density (% TD) | Final density (% TD) | Final porosity (%) | Sintering time (min) | Sintering temp (° C.) |
|---|---|---|---|---|---|
| Uniaxially pressed 20 mm diameter cylinders | | | | | |
| 20 | 63 | 72 | 29 | 15 | 1200 |
| 20 | 65 | 74 | 26 | 30 | 1200 |
| 20 | 63 | 73 | 27 | 60 | 1200 |
| 40 | 71 | 79 | 21 | 15 | 1200 |
| 40 | 71 | 81 | 19 | 30 | 1200 |
| 40 | 71 | 80 | 20 | 60 | 1200 |
| 80 | 82 | 89 | 11 | 15 | 1200 |
| 80 | 83 | 90 | 10 | 30 | 1200 |
| 80 | 83 | 91 | 9 | 60 | 1200 |
| Cold isostatically pressed rod | | | | | |
| 100 | 91 | 98 | 2 | 60 | 1200 |

General Microwave Processing Considerations—The local heat generation rate for microwave processing depends on the product of the loss tangent and the squared magnitude of the internal electric field. For a given input power the microwave field in a cavity build up until the total loss equals the input power. As the loss tangent of many materials increases with temperature, the microwave fields in the cavity are more likely to build up to high values at low processing temperatures—with the associated likelihood of arcing and plasma formation—than at high temperatures when the increased loss tangents limit the microwave field build up. During 2.45 GHz processing, the workpiece and casket are initially heated at low power (~500 W) and the microwave power is slowly increased to maintain a constant rate of temperature increase while minimizing plasma formation. The 3-stub tuner is adjusted to keep the reflected power to a minimum as the microwave power is increased. Plasma formation was controlled by decreasing the microwave power during the initial heating phase if necessary and by momentarily switching off the microwave power when plasma generation occurred. Plasma formation was not generally a problem at sintering temperatures as then the microwaves coupled efficiently to the workpiece keeping the field intensity relatively low. Argon gas flow was maintained during the cool-down phase if used in the sintering phase to minimize surface oxidation. A millitorr vacuum was used in some experiments and did not lead to plasma formation.

Obviously, many modifications and variations are possible in light of the above teachings. It is therefore to be understood that the claimed subject matter may be practiced otherwise than as specifically described. Any reference to claim elements in the singular, e.g., using the articles "a," "an," "the," or "said" is not construed as limiting the element to the singular.

What is claimed is:

1. A method comprising:

placing a compacted metal powder inside a cylindrically-shaped susceptor and in an inert atmosphere or a vacuum; and applying microwave or millimeter-wave energy to the powder until the powder is sintered;

wherein the susceptor coaxially surrounds the microwave or millimeter-wave energy.

2. The method of claim 1, wherein the compacted metal powder comprises titanium.

3. The method of claim 1, wherein the compacted metal powder comprises titanium and one or more other metals.

4. The method of claim 1, wherein the compacted metal powder comprises an alloy of titanium and one or more other metals.

5. The method of claim 1, wherein the compacted metal powder has a density of at least about 30% of the bulk density of the metal.

6. The method of claim 1;

wherein the compacted metal powder has a density of 30-90% of the bulk density of the metal; and wherein the sintered powder has a porosity of 50% or less.

7. The method of claim 1, wherein the microwave or millimeter-wave energy has a frequency of from 0.9 to 90 GHz.

8. The method of claim 1, wherein applying the energy heats at least a portion of the powder to a temperature from about half the melting point of the metal powder to a temperature below the melting point of the powder.

9. The method of claim 1, wherein applying the energy is performed for about 10 minutes to about 1 hour.

10. The method of claim 1, wherein applying the energy is performed for more than 1 hour.

11. The method of claim 1, wherein the energy passes through an open end of the cylindrical susceptor before contacting the powder.

12. The method of claim 11, further comprising:

monitoring the temperature of the powder using a pyrometer.

13. The method of claim 1, wherein the energy passes through a 3-stub tuner before entering a chamber containing the susceptor and powder.

14. The method of claim 1, wherein an oxygen sensor is in a chamber containing the susceptor and powder.

15. The method of claim 14, wherein the chamber comprises an atmospheric control port.

* * * * *